US006209326B1

(12) United States Patent
Mandai et al.

(10) Patent No.: US 6,209,326 B1
(45) Date of Patent: Apr. 3, 2001

(54) GAS TURBINE COMBUSTOR

(75) Inventors: Shigemi Mandai; Koichi Nishida; Masataka Ota; Tatsuo Ishiguro; Mitsuru Inada; Hideki Haruta, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/244,030

(22) Filed: Feb. 4, 1999

(30) Foreign Application Priority Data

Feb. 9, 1998 (JP) ..... 10-027049
Mar. 18, 1998 (JP) ..... 10-068431

(51) Int. Cl.[7] ..... F02C 1/00
(52) U.S. Cl. ..... 60/748
(58) Field of Search ..... 60/748

(56) References Cited

U.S. PATENT DOCUMENTS 2,679,137 5/1954 Probert ..... 60/39.72
4,453,384 * 6/1984 Pask ..... 60/737
5,321,948 6/1994 Leonard ..... 60/737
5,431,017 7/1995 Kobayashi et al. ..... 60/723
5,573,395 11/1996 Althaus et al. ..... 431/271

FOREIGN PATENT DOCUMENTS 39 13 047 10/1990 (DE) .
0 594 127 4/1994 (EP) .
0 747 636 12/1996 (EP) .

* cited by examiner

*Primary Examiner*—Charles G. Freay
*Assistant Examiner*—Ehud Gartenberg
(74) *Attorney, Agent, or Firm*—Wenderoth, Lind & Ponack, L.L.P.

(57) ABSTRACT

To prepare a more homogeneous premixture than that of the device of the prior art thereby to suppress an NOx emission and to lower a fuel feed pressure.

A gas turbine combustor comprising: an outer cylinder 106 having main swirlers 101 therein and adapted to be fed with air; and an annular fuel feed manifold 110 disposed at the outer circumference of the outer cylinder 106 on the upstream or downstream side of the main swirlers 101 and having a plurality of nozzle ports 111 communicating with the inside of the outer cylinder 106, so that a fuel is injected from the outer circumference to the center of the air flowing in the outer cylinder 106.

12 Claims, 7 Drawing Sheets

GAS TURBINE COMBUSTOR

BACKGROUND OF THE INVENTION

1. Field of the Invention

The present invention relates to a gas turbine combustor.

2. Related Art

Gas turbine combustors of the prior art will be described with reference to FIGS. 5 and 6.

In a gas turbine combustor of the prior art, as shown in FIGS. 5 and 6, there is arranged at the center of the section of the combustor a pilot fuel nozzle 104 for producing a flame portion. Around this pilot fuel nozzle 104, there is a cylindrical outer cylinder 106, on which there are arranged a plurality of main fuel nozzles 102 for producing a premixed gas of a fuel and air.

The pilot fuel nozzle 104 is provided with a pilot swirler 103. Each of the main fuel nozzles 102 is provided with main swirlers 101 which are arranged around the main fuel nozzle 102 and extend to the outer cylinder 106. A plurality of nozzle ports 105 are opened in the nozzle body wall face of the main fuel nozzle 102 downstream of the main swirlers 101.

In the construction described above, the air and the fuel flow in the directions, as indicated by arrows in FIGS. 5 and 6, so that the air and the fuel are fed from a plurality of main swirlers 101 and one pilot swirler 103, and from a plurality of main fuel nozzles 102 and one pilot fuel nozzle 104, respectively, to the combustion zone.

The fuel thus fed from the main fuel nozzle 102 is injected from the nozzle ports 105 in the nozzle body wall face so that it is mixed with the air flowing through the main swirlers 101 around the nozzle outer circumference to prepare a premixed gas.

In the combustor of the prior art, the main fuel nozzle 102, the main swirlers 101 and the outer cylinder 106 construct a main fuel nozzle device.

The main fuel nozzle device of the gas turbine combustor of the prior is of the type in which the fuel is injected from the nozzle ports formed in the wall face of the nozzle body, as described hereinbefore.

This system has a problem in that the premixture to be prepared in the vicinity of the exits of the main swirlers has a tendency to become a gas having a higher fuel concentration at its center portion. Another problem is that the pressure for feeding the fuel has to be set at a high level for establishing a fuel penetration necessary for mixing the fuel, injected from the main fuel nozzles, efficiently with the air flow.

Another example of the gas turbine combustor of the prior art is shown in FIG. 7.

In a gas turbine combustor 201 of the prior art, as shown in FIG. 7, there is formed a combustion chamber 212 which is enclosed and defined by both an axially symmetrical cylindrical upstream inner cylinder 206 and a downstream inner cylinder 207 connected at its leading end portion to the rear end portion of the upstream inner cylinder 206.

The downstream inner cylinder 207 forming the combustion chamber 212 together with the upstream inner cylinder 206 is composed of a plurality of cylinders, with these cylinders increasing in diameters from the inner cylinder 206 to a downstream-most cylinder. A clearance is formed at the joint between adjacent inner cylinders 207 so that compressed air flowing outside of the upstream inner cylinder 206 and the downstream inner cylinder 207 may flow as cooling air 217 through this clearance into the downstream inner cylinder 207, and then may flow further along the inner circumference of the downstream inner cylinder 207 to cool the downstream inner cylinder 207 from its inside to then protect it from the combustion gas which is at a high temperature and under a high pressure. Air as indicated by arrows 204 and 210 flows respectively through swirlers 203 and 209.

In the gas turbine combustor 201 of the prior art, as has been described hereinbefore, a pilot nozzle 202 and a main nozzle 208 are arranged in the upstream inner cylinder 206 on the upstream side of the combustion chamber 212. A pilot fuel 213 and a main fuel 215, i.e. the fuels necessary for the operation of the gas turbine, are fed to the upstream side of the combustion chamber 212. As a result, the ratio of the unburned fuel to the fed fuel has a high value on the upstream side but gradually lowers toward the downstream side, as plotted in the distribution of the unburned fuel in the axial direction of the combustor in FIG. 8.

Specifically, the ratio of the fuel being burned in a section in the combustion chamber 212, i.e., the so-called "sectional load factor" is high on the upstream side, but a certain unburned fuel ratio is maintained even within a range on the downstream side so that the sectional load factor is shared. As a result, the combustion in the combustion chamber 212 can maintain a stable combustion and a low NOx emission.

Gas turbines have been demanded in recent years to have a high temperature and a high pressure of the combustion gas for a larger size and a higher efficiency. However, the reaction rate of the fuel, as fed to the combustion chamber 212, is increased by the high temperature and pressure of the combustion gas. If 100% of the fuels 213 and 215 required for running the gas turbine are fed on the upstream side, therefore, they are instantly burned on the upstream side, and the unburned gas has a small distribution on the downstream side. As a result, the sectional load factor rises on the upstream side and causes problems of an unstable combustion state and an increase in the NOx emission.

SUMMARY OF THE INVENTION

An object of the invention is to provide a gas turbine combustor which is enabled to prepare a homogeneous premixture, to thereby suppress an NOx emission by mixing a main fuel and air homogeneously without requiring a high fuel feeding pressure.

Another object of the invention is to provide a gas turbine combustor which can eliminate the disadvantage of the instability in the combustion state or the increase in the NOx emission caused when 100% of fuel is fed to the upstream side of the combustion chamber, as in the gas turbine of the prior art. When this gas turbine is demanded to have high temperature and pressure of the combustion gas for a large size and a high efficiency.

In order to solve the above-specified problems, according to the invention, there is provided a gas turbine combustor comprising: a cylindrical outer cylinder into which air is fed; main swirlers disposed in the outer cylinder; and an annular fuel feed manifold disposed on the outer circumference of the outer cylinder on the upstream or downstream side of the main swirlers, and having a plurality of nozzle ports communicating with the inside of the outer cylinder.

In the invention, the fuel is injected from the outer circumference to the center of the air flowing in the outer cylinder so that a more homogeneous premixture than that of the device of the prior art can be prepared to suppress the NOx emission.

On the other hand, it is possible to lower the high fuel feed pressure which has been demanded in the device of the prior art for the fuel to reach the outer circumference of the air flow.

In order to solve the aforementioned problem in the gas turbine combustor having the combustion chamber formed by the upstream inner cylinder and the downstream inner cylinder, according to the invention, the main fuel is divided to be fed in the direction of the flow of the burning air in the combustion chamber which is formed by the upstream inner cylinder and the downstream inner cylinder.

As a result, even in the gas turbine in which the high temperature and pressure of the combustion gas are demanded for the larger size and the higher efficiency so that the reaction rate of the fuel fed to the inside of the combustion chamber is raised by the high temperature and pressure of the combustion gas, the unburned fuel ratio of the fuel fed to the inside of the combustion chamber can obtain a distribution in which the ratio gently fluctuates in the flow direction of the burning air flowing in the combustion chamber.

That is to say, the sectional load factor can be prevented from locally rising especially on the upstream side, to thereby stabilize the combustion state in the combustion chamber and to reduce the NOx emission accompanying the combustion.

The main nozzles for dividing the feeding the main fuel to the inside of the combustion chamber are extended at the individual feed positions through the upstream inner cylinder and the downstream inner cylinder.

As a result, in addition to the above-specified operations and effects, the distribution of the unburned fuel in the axial direction of the combustion chamber can be individually controlled by controlling the fuels to be injected from the individual main nozzles, to make the combustion state stabler and to reduce the NOx emission effectively.

DESCRIPTION OF THE PREFERRED EMBODIMENTS

Figure 1A:
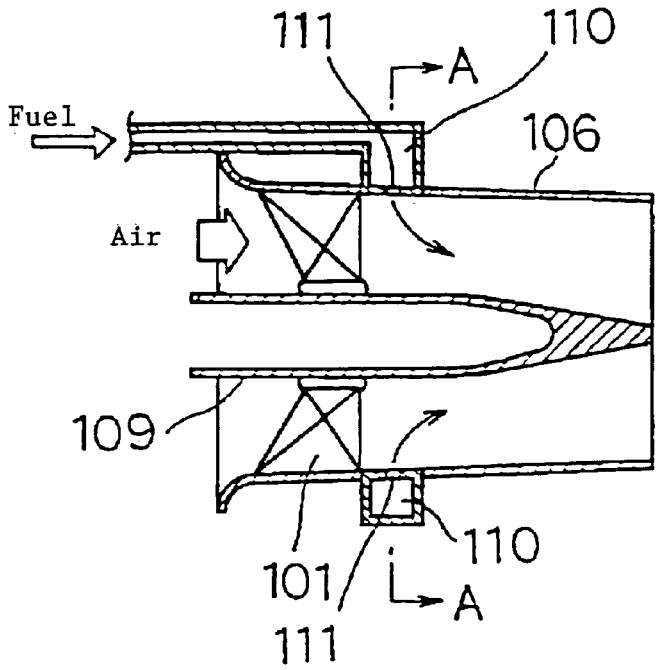
In FIGS. 1(*a*)–1(*c*) explaining a main fuel nozzle device of a gas turbine combustor according to a first embodiment of the invention, FIG. 1(*a*) is a side sectional view, (*b*) a sectional view taken in the direction of arrows A—A of FIG. 1(*a*), and FIG. 1(*c*) a sectional side elevational view of the gas turbine combustor.

A gas turbine combustor according to the embodiments of the invention will be described with reference to the accompanying drawings.

[First Embodiment]

All first embodiment will be described with reference to FIG. 1.

A gas turbine combustor is constructed to include: a cylindrical outer cylinder 106; a swirler supporting member 109 of a hollow rod shape disposed in the central axis portion of the outer cylinder 106; main swirlers 101 formed between the supporting member 109 and the outer cylinder 106; and an annular fuel feed manifold 110 disposed on the downstream side of the main swirlers 101 and on the outer circumference of the outer cylinder 106, and having a plurality of nozzle ports 111 communicating with the inside of the outer cylinder 106.

Figure 1B:
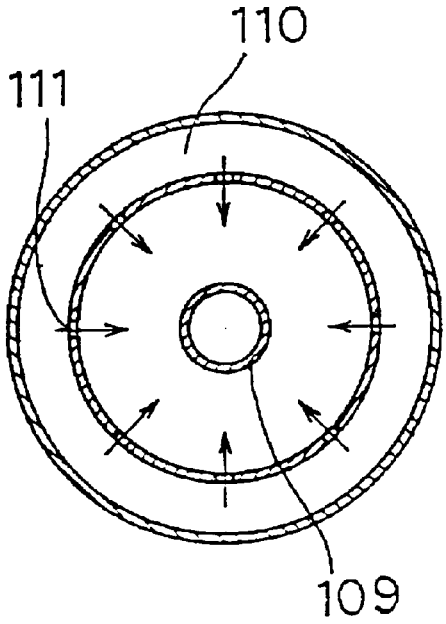
Figure 1C:
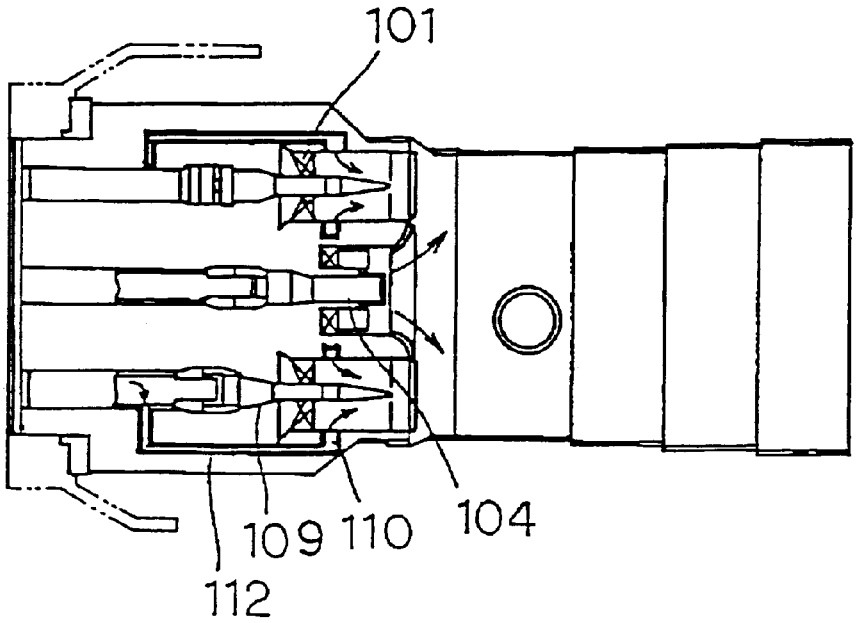

The feed of the fuel to the fuel feed manifold 110 is effected, as shown in FIG. 1(*c*), by forming a bypass passage 112 at the swirler supporting member 109, used as the main fuel nozzle in the device of the prior art, and by connecting the fuel feed manifold 110 to the bypass passage 112.

With this construction, the fuel is injected from the plurality of nozzle ports 111, as formed in the fuel feed manifold 110, into the outer cylinder 106 and is mixed With the air, as fed from the main swirlers 101, to prepare a premixture.

In this embodiment, the fuel, as fed from the nozzle ports 111, is injected from the outer circumference to the center of the flow of the air fed from the main swirlers 101, so that the fuel concentration can be homogenized to prepare a homogeneous premixture and thereby suppress the NOx emission to a low level.

In the case of the device of the prior art, on the other hand, a high fuel feed pressure is required for enabling the fuel reach to the outer circumference of the air flow.

Figure 2:
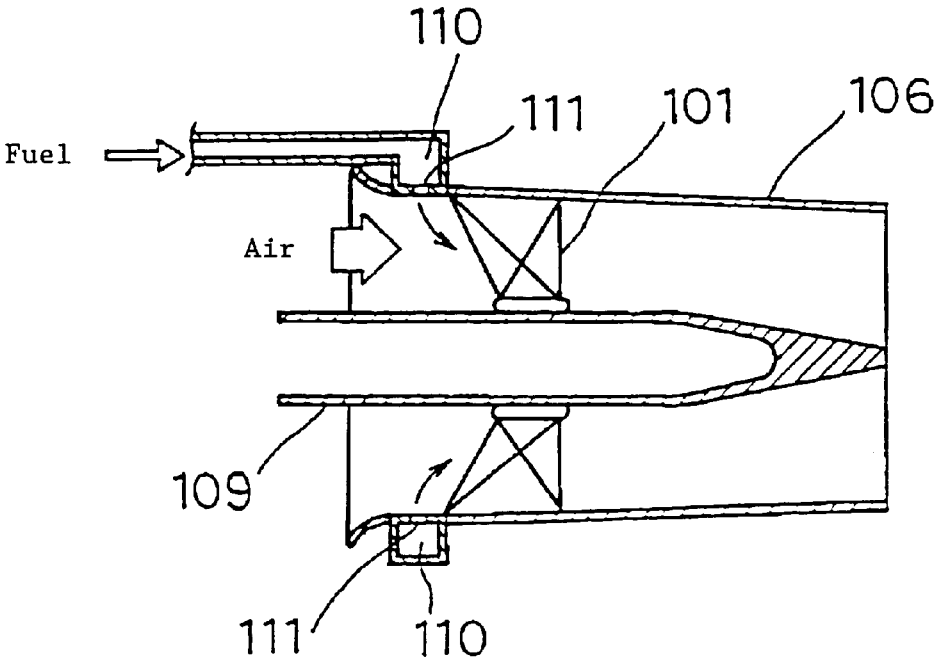
FIG. 2 is an explanatory diagram of a modified example of the first embodiment of the invention.
Figure 5:
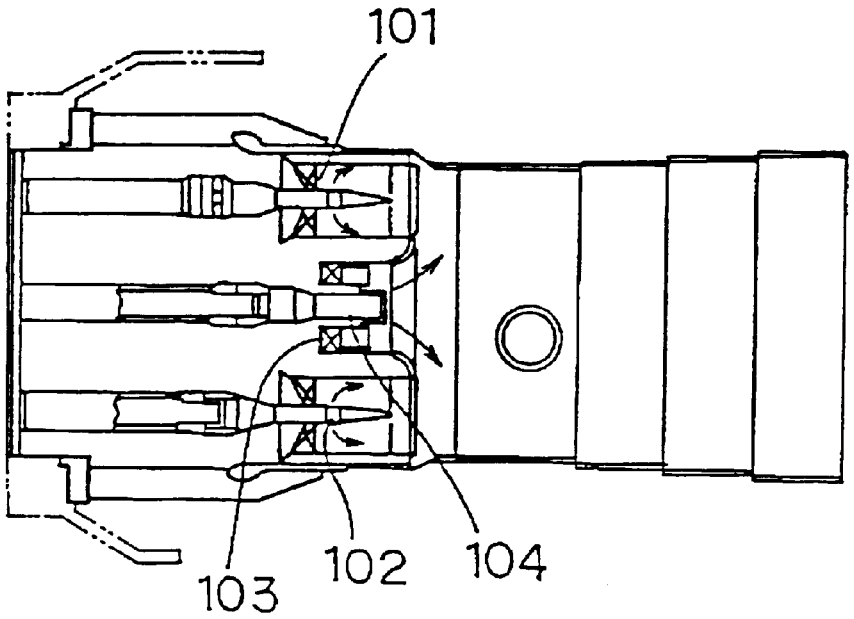
Fig. 5 (Prior Art)
FIG. 5 is a sectional side elevational view of a gas turbine combustor of the prior art.

In this embodiment, the fuel feed manifold 110 is arranged on the downstream side of the main swirlers 101 but may be arranged on the upstream side of the main swirlers 101, as shown in FIG. 2. In this modification, a better premixture can be prepared, although a dangerous flashback may occur so that countermeasures for preventing this danger have to be undertaken.

As has been described hereinbefore in connection with the first embodiment, the gas turbine combustor of the invention is constructed to include: an outer cylinder having the main swirlers therein and adapted to be fed with the air; and an annular fuel feed manifold disposed on the upstream or downstream of the main swirlers and at the outer circumference of the outer cylinder, and having a plurality of nozzle ports communicating with the inside of the outer cylinder. The fuel is injected from the outer circumference to the center of the air flow in the outer cylinder so that the homogeneous premixture can be prepared to suppress the NOx emission and to lower the fuel feed pressure.

[Second Embodiment]

A gas turbine combustor according to a second embodiment will be described with reference to FIG. 3.

Figure 3:
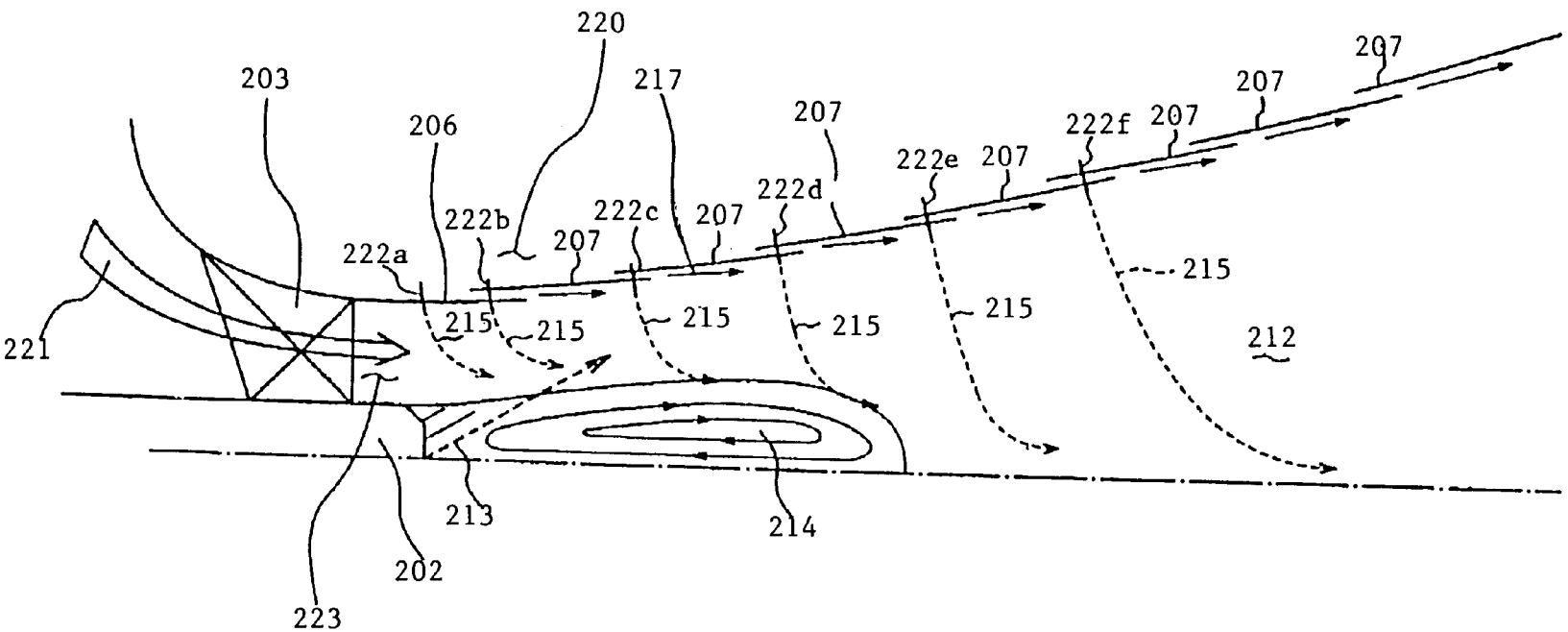
FIG. 3 is a partial sectional view showing a gas turbine combustion according to a second embodiment of the invention.
Figure 7:
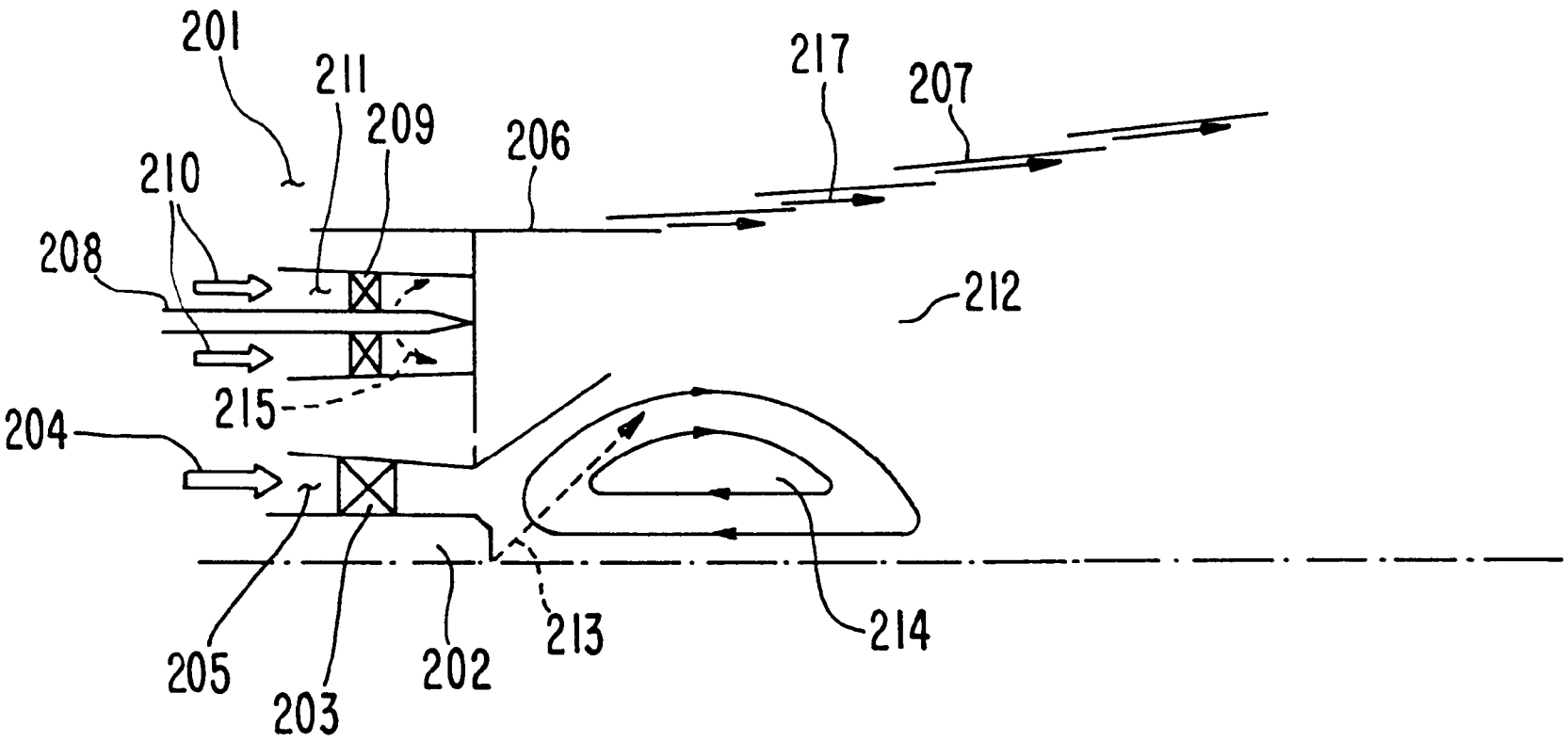
FIG. 7 (PRIOR ART)
FIG. 7 is a longitudinal sectional view showing a portion of another gas turbine combustor of the prior art.
Figure 8:
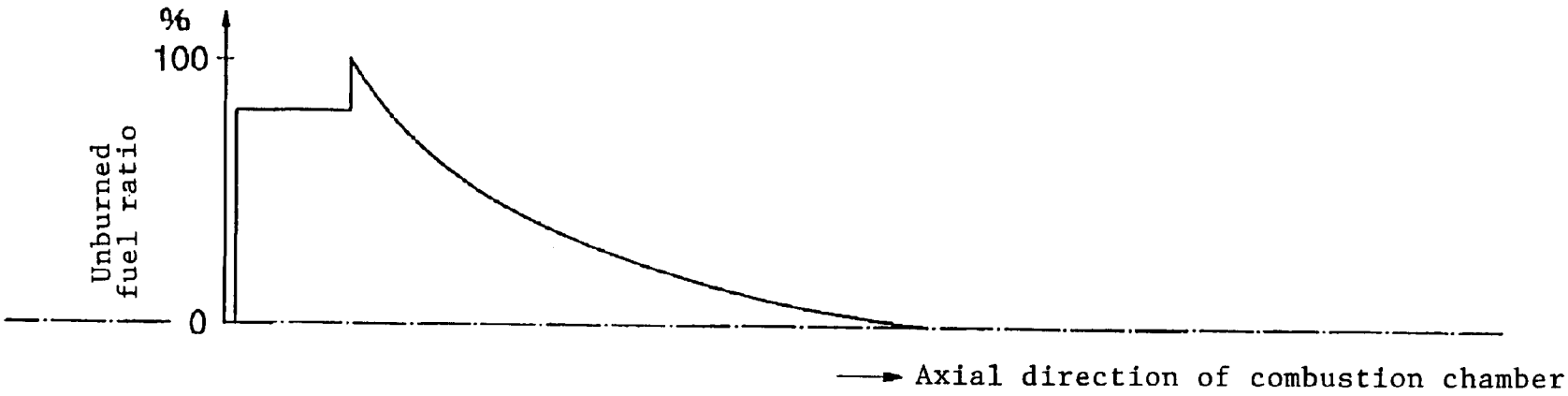
Fig. 8 (Prior Art)
FIG. 8 is a diagram plotting the ratio of an unburned fuel of a main fuel, as taken in the axial direction of the combustion chamber shown in FIG. 7.

In FIG. 3, the members identical or similar to those of the gas turbine combustor of the prior art shown in FIG. 7 will be designated by the common reference numerals, and their description will be omitted.

In a gas turbine combustor 220 of this embodiment, as shown in FIG. 3, a combustion chamber 212 is enclosed and defined by an upstream axially symmetrical inner cylinder 206, and a downstream inner cylinder 207 connected at its leading end portion to the rear end portion of the upstream inner cylinder 206. A pilot nozzle 202 is mounted at the center portion on the upstream wall portion of the combustion chamber 212. At the same time, the pilot nozzle 202 is equipped at a circumferentially equal pitch on its outer circumference with pilot swirlers 203, which are fixed at their roots on the outer circumference of the pilot nozzle 202 for establishing a swirling flow in the burning air 221 to be fed to the front of the pilot nozzle 202.

On the inner cylinders 206 and 207 on the downstream side of the pilot swirlers 203, there are arranged a plurality of main nozzles 222 or main nozzles 222*a* to 222*f*, which are extended through the upstream inner cylinder 206 and the downstream inner cylinder 207 in a spaced axial relationship through which the burning air 221 is to flow.

In the gas turbine combustor 220 of this embodiment, a pilot fuel 213 is fed from the pilot nozzle 202, and the burning air 221 is fed, while being swirled by the pilot swirlers 203, to the combustion chamber 212.

In front of the pilot nozzle 202, therefore, a flame holding recirculation zone 214 is established on the upstream side of the combustion chamber 212 to hold the flame as in the gas turbine combustor 201 of the prior art.

At a light load time of the gas turbine, moreover, the combustion gas to be produced in the combustion chamber 212 has a low temperature so that a main fuel 215 to be fed from the main nozzles 222 to the inside of the combustion chamber 212 has a low reaction rate. As a result, the main fuel 215 is fed exclusively from the pilot nozzle 202 and the main nozzle 222*a* formed through the upstream inner cylinder 206, so that it may be fed entirely on the upstream side of the combustion chamber 212.

At a heavy load time of the gas turbine, on the other hand, the main fuel 215 is additionally fed from the main nozzles 222*b* to 222*f* formed through the downstream inner cylinder 207, so that the main fuel 215 may also be fed to the downstream side of the combustion chamber 212 so as to disperse in the axial direction of the combustion chamber 212.

Figure 4:
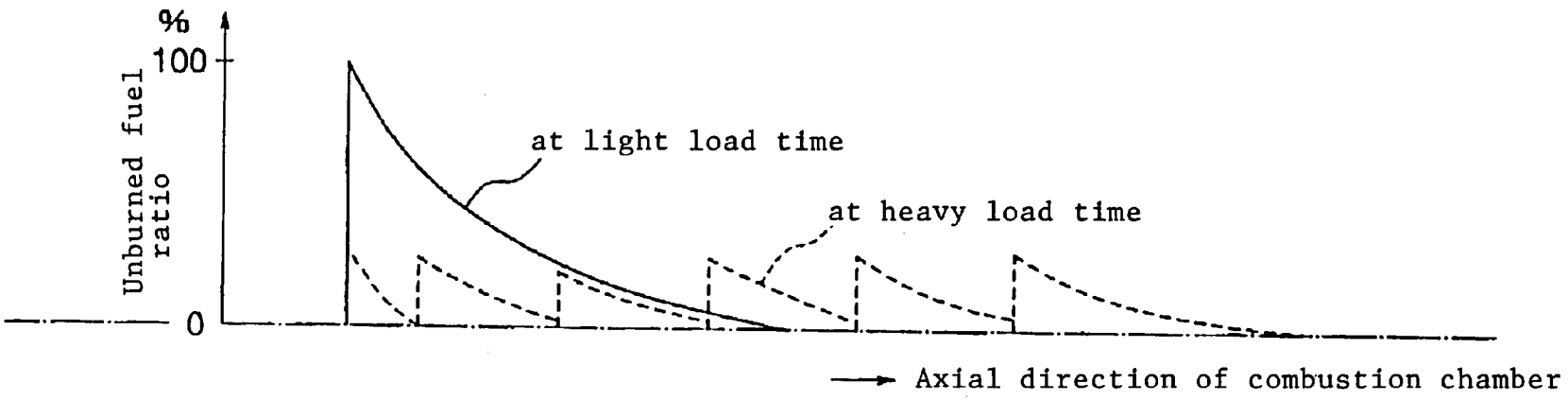
FIG. 4 is a diagram illustrating an unburned fuel ratio of a main fuel, as taken in the axial direction of the combustion chamber shown in FIG. 3.
Figure 6A:
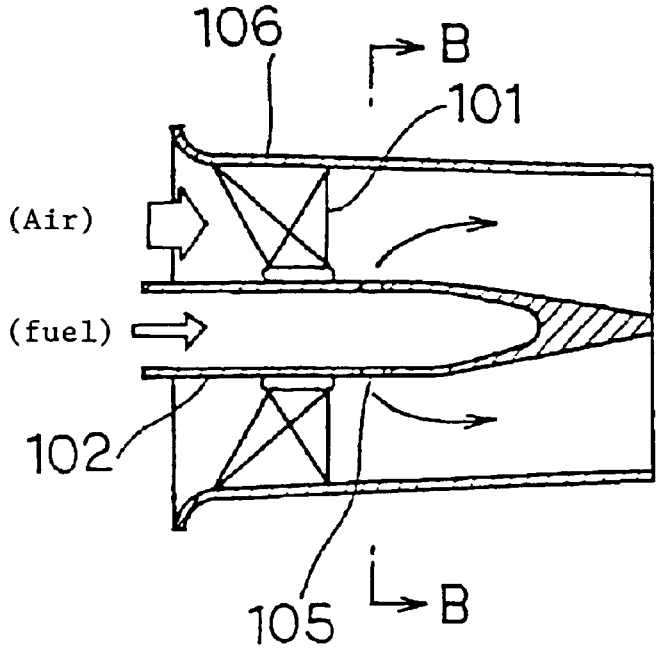
Fig. 6(a) (Prior Art)
In FIGS. 6(*a*) and 6(*b*) explaining a main fuel nozzle device in a gas turbine combustor of the prior art, FIG. 6(*a*) is a sectional side elevational view, and FIG. 6(*b*) is a sectional view taken in the direction of arrows B—B of FIG. 6(*a*)
Figure 6:
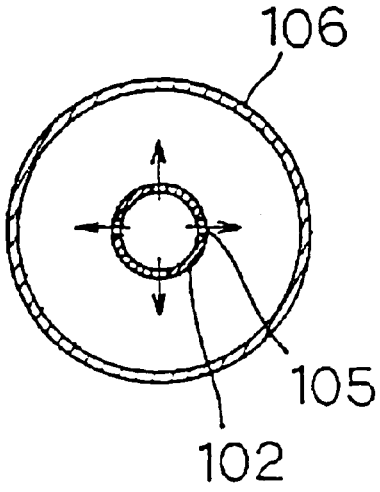
Fig. 6 (b) (Prior Art)

At the light load time of the gas turbine, more specifically, the unburned ratio of the main fuel 215 in the axial direction in the combustion chamber 212 is plotted by the solid line in FIG. 4 by feeding 100% of the main fuel 215 to the upstream side of the combustion chamber 212. At the high load time of the gas turbine, the unburned ratio of the main fuel 215 in the axial direction of the combustion chamber 212 is plotted by dotted lines in FIG. 4 by feeding the main fuel 215, as demanded for running the gas turbine, in a manner to distribute it from the upstream side to the downstream side of the combustion chamber 212.

Thus in the gas turbine combustor 220 of this embodiment, at the light load time of the gas turbine when the combustion gas has a low temperature and a low pressure, the reaction rate of the main fuel 215 is so low that the safe combustion state is realized by feeding the main fuel 215 wholly from the upstream side of the combustion chamber 212 to hold the flame with in the recirculation zone 214.

In short, the operations are basically identical to those of the combustor 201 of the prior art.

At the heavy load time of the gas turbine when the combustion gas has a high temperature and a high pressure, on the contrary, the reaction rate of the main fuel 215 is raised so that the sectional load factor on the upstream side of the combustion chamber 212 increases to make the combustion state unstable if 100% of the main fuel 215 is fed from the upstream side of the combustion chamber 212.

This increase in the sectional load factor forms a hot gas zone locally in the combustion chamber 212 to increase the NOx emission.

At the heavy load time, therefore, the main fuel 215 is divided and also fed to the downstream side of the combustion chamber 212 so that the sectional load factor on the upstream side of the combustion chamber 212 can be lowered and distributed to the downstream side of the combustion chamber 212 to realize the stable combustion state and to eliminate the load hot gas zone in the combustion chamber 212, and to thereby suppress the NOx emission.

When the combustion gas takes such high temperature and pressure conditions for the gas turbine load satisfying the spontaneous ignition conditions of the main fuel 215, moreover, the stable burning state can be realized without any feed of the pilot fuel 213 to the recirculation zone 214, by extremely reducing or interrupting the feed of the pilot fuel 213 from the pilot nozzle 202. At the same time, the NOx emission can be suppressed by decreasing the local hot gas zone which will be established according to the combustion of the pilot fuel 213.

On the other hand, the air passage for feeding the combustion chamber 212 with the air necessary for the combustion is composed, in the prior art, of two lines: a pilot air passage 205 and a plurality of main air passages 211. However, air flow can be sufficient by providing only one burning air passage 223, so that it becomes unnecessary to provide main swirlers 209 which have been assigned to each of the main air passages 211.

The cooling air 217, although not described in this embodiment, for protecting the downstream inner cylinder 207 from the gas of high temperature and pressure is introduced, as in the construction shown in FIG. 7, into the combustion chamber 212 and is guided along the inner circumference of the downstream inner cylinder 207 to cool the inner cylinder 207.

In the gas turbine combustor according to the second embodiment of the invention thus far described, the main fuel, which is ignited for the main combustion with the flame held by the pilot nozzle arranged on the axis of the axially symmetrical cylindrical upstream inner cylinder, is divided and fed in the flow direction of the burning air in the combustion chamber, through which the burning air is swirled and fed by the swirler arranged at the outer circumference of the pilot nozzle.

As a result, even if the reaction rate of the main fuel fed to the inside of the combustion chamber is increased as in recent years by the combustion gas of high temperature and pressure at the high load time of the gas turbine, the unburned fuel ratio of the main fuel fed to the inside of the combustion chamber can obtain a distribution in which the ratio gently fluctuates in the flow direction of the burning air flowing in the combustion chamber. As a result, the sectional load factor can be prevented from locally increasing on the upstream side, to thereby stabilize the combustion state and to reduce the NOx emission.

When the combustion gas takes a high temperature and a high pressure so that the gas turbine load satisfies the spontaneous ignition conditions for the main fuel, moreover, the stable combustion state can be realized, and the local hot gas zone can be reduced to suppress the NOx emission without extremely reducing the pilot fuel to be fed by the pilot nozzle or by interrupting the feed of the pilot fuel to the recirculation zone.

In the gas turbine combustor of the invention, the main nozzles for feeding the main fuel to the inside of the combustion chamber are extended through the upstream inner cylinder and the downstream inner cylinder forming the combustion chamber at their feed positions which are divided in the flow direction of the burning air.

As a result, the distribution of the unburned fuel in the axial direction of the combustion chamber can be freely controlled by controlling the fuels to be injected from the individual main nozzles, to thereby make the combustion state stabler and to reduce the NOx emission more effectively.

What is claimed is:

1. A combustor for a gas turbine, comprising: a casing to be supplied with air; a hollow supporting member disposed generally centrally within said casing; at least one air swirler positioned between said supporting member and said casing to swirl air as the air passes through said at least one air swirler; and a fuel feed manifold positioned about said casing and in fluid communication with an interior of said casing to supply fuel to the interior of said casing in a direction generally towards a center of said casing, such that the fuel becomes mixed with the air; and further comprising a passage interconnecting an interior of said supporting member with said fuel feed manifold, whereby the fuel to be supplied to the interior of said casing flows from the interior of said supporting member through said passage and into said fuel feed manifold.

2. The combustor according to claim 1, wherein said fuel feed manifold is mounted on an outer periphery of said casing and communicates with the interior of said casing via openings extending through said casing.

3. The combustor according to claim 2, wherein said casing is cylindrical and said fuel feed manifold is annular.

4. The combustor according to claim 3, wherein said at least one air swirler positioned between said supporting member and said casing includes a plurality of air swirlers supported by said supporting member.

5. The combustor according to claim 4, wherein said fuel feed manifold is positioned to supply the fuel to the interior of said casing upstream of said at least one air swirler.

6. The combustor according to claim 4, wherein said fuel feed manifold is positioned to supply the fuel to the interior of said casing downstream of said at least one air swirler.

7. The combustor according to claim 2, wherein said at least one air swirler positioned between said supporting member and said casing includes a plurality of air swirlers supported by said supporting member.

8. The combustor according to claim 2, wherein said fuel feed manifold is positioned to supply the fuel to the interior of said casing upstream of said at least one air swirler.

9. The combustor according to claim 2, wherein said fuel feed manifold is positioned to supply the fuel to the interior of said casing downstream of said at least one air swirler.

10. The combustor according to claim 1, wherein said at least one air swirler positioned between said supporting member and said casing includes a plurality of air swirlers supported by said supporting member.

11. The combustor according to claim 1, wherein said fuel feed manifold is positioned to supply the fuel to the interior of said casing upstream of said at least one air swirler.

12. The combustor according to claim 1, wherein said fuel feed manifold is positioned to supply the fuel to the interior of said casing downstream of said at least one air swirler.

* * * * *